US008368326B2

(12) United States Patent
Chen

(10) Patent No.: US 8,368,326 B2
(45) Date of Patent: Feb. 5, 2013

(54) SHAKABLE LIGHTING ELEMENT

(76) Inventor: Chung-Ping Chen, Shu-Lin (TW)

( * ) Notice: Subject to any disclaimer, the term of this patent is extended or adjusted under 35 U.S.C. 154(b) by 323 days.

(21) Appl. No.: 12/910,512

(22) Filed: Oct. 22, 2010

(65) Prior Publication Data

US 2012/0098466 A1 Apr. 26, 2012

(51) Int. Cl.
*H05B 37/02* (2006.01)

(52) U.S. Cl. ..... 315/362; 362/373

(58) Field of Classification Search ..... 313/500–512; 315/362; 362/373, 118
See application file for complete search history.

(56) References Cited

U.S. PATENT DOCUMENTS 5,208,486 A * 5/1993 Revis ..... 307/122
5,912,804 A * 6/1999 Lawson et al. ..... 361/704

* cited by examiner

*Primary Examiner* — Anh Mai
*Assistant Examiner* — Elmito Breval
(74) *Attorney, Agent, or Firm* — Pro-Techtor Int'l Services

(57) ABSTRACT

A shakable lighting element includes a main unit, an inner seat, a conductive rod, a spring, a swing block, an LED and an outer shade. The inner seat is latched into the main unit and is installed with the spring and the LED. The spring is connected with the swing block, an end of the conductive rod penetrates the inner seat to be in contact with a battery and the other end is transfixed in the spring. When the main unit shakes, the swing block drives the spring to swing and when the spring touches the conductive rod, the LED illuminates.

2 Claims, 5 Drawing Sheets

SHAKABLE LIGHTING ELEMENT

BACKGROUND OF THE INVENTION a) Field of the Invention

The present invention relates to device which is able to activate an LED (Light Emitting Diode) to illuminate after shaking.

b) Description of the Prior Art

A conventional lighting element is generally controlled by a touch switch or a push switch to illuminate. However, due to a limitation by an expensive cost of the abovementioned switch, the cost cannot be reduced effectively for this kind of lighting element to develop a novice product;

therefore, improvement is required.

SUMMARY OF THE INVENTION

Accordingly, the primary object of the present invention is to provide a shakable lighting element which is constituted by a main unit, an inner seat, a conductive rod, a spring, a swing block, an LED and an outer shade, with that when the main unit shakes, the swing block will drive the spring to swing and touch the conductive rod, allowing the LED to illuminate.

To enable a further understanding of the said objectives and the technological methods of the invention herein, the brief description of the drawings below is followed by the detailed description of the preferred embodiments.

BRIEF DESCRIPTION OF THE DRAWINGS

FIG. 2-1 shows a three-dimensional schematic view of an inner seat of the present invention.

DETAILED DESCRIPTION OF THE PREFERRED EMBODIMENTS

Figure 1:
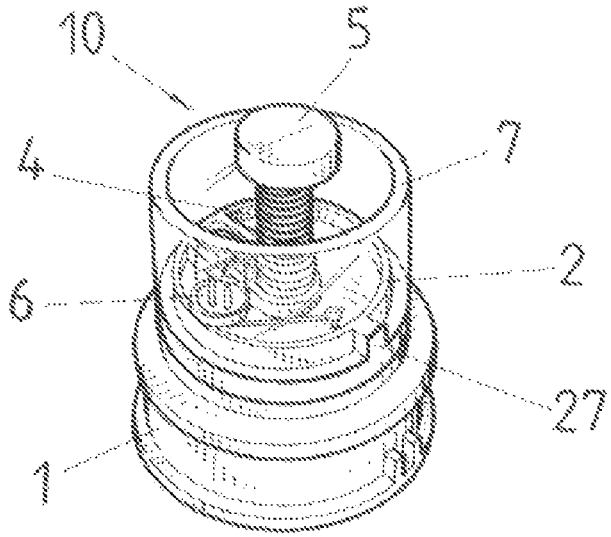
FIG. 1 shows a three-dimensional schematic view of the present invention.
Figures 1, 2:
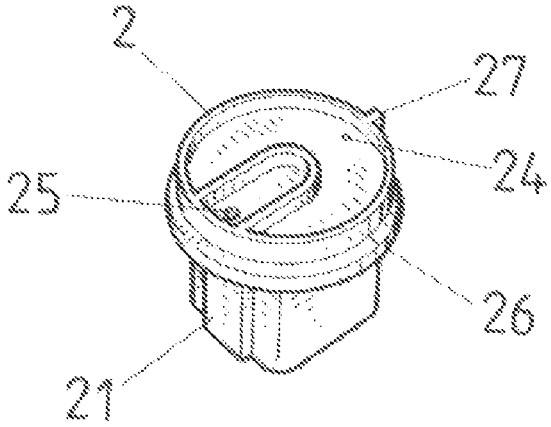
FIG. 2 shows an exploded view of the present invention.
Figure 2:
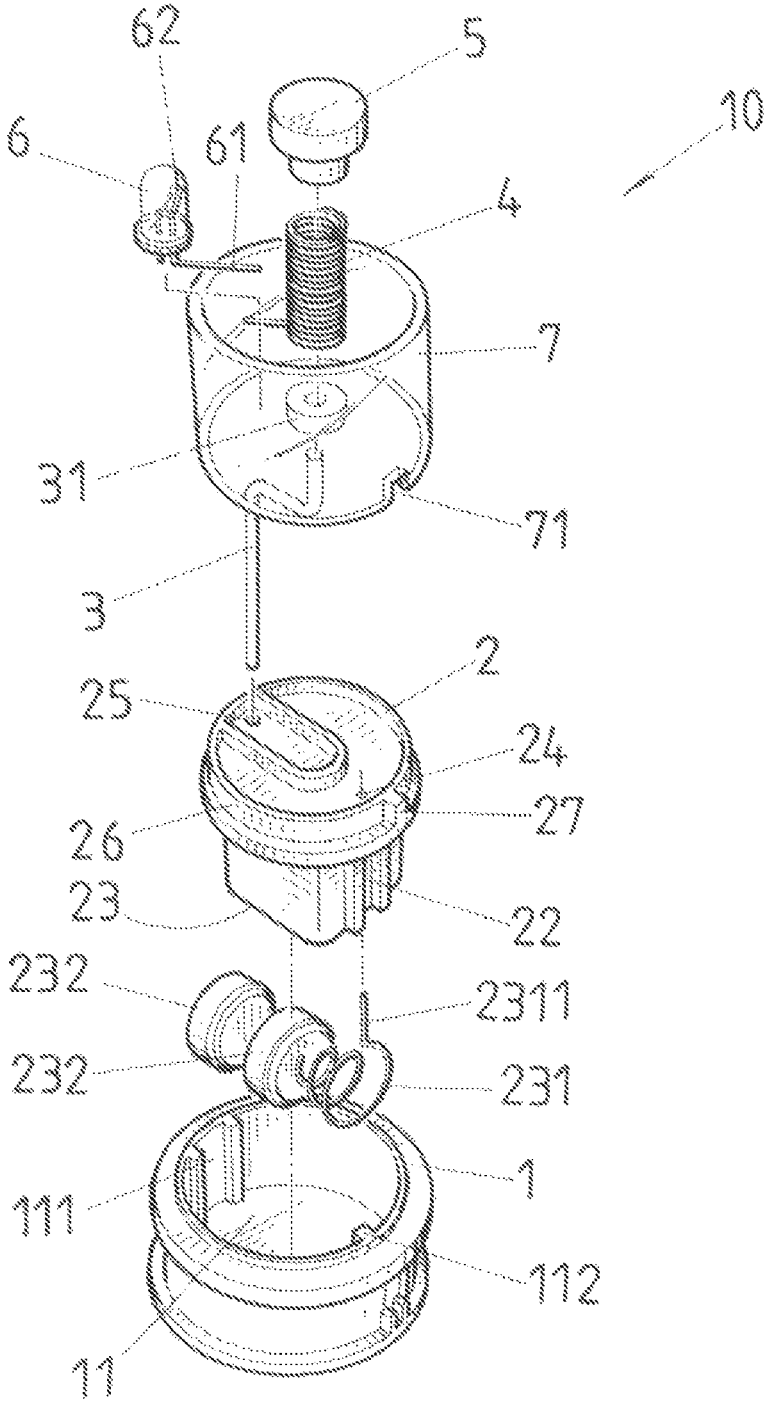
Figure 3:
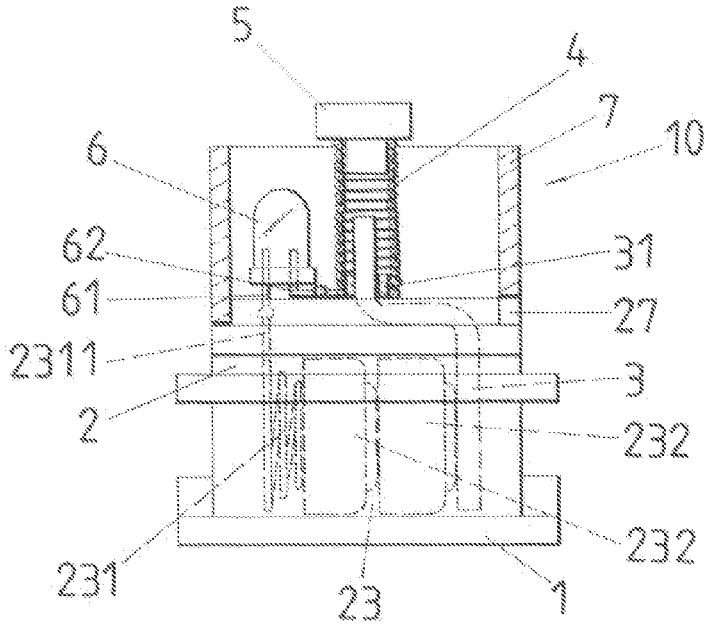
FIG. 3 shows a cutaway view of the present invention.

Referring to FIGS. 1 to 3, a lighting element 10, as disclosed by the present invention, comprises a main unit 1, an inner seat 2, a conductive rod 3, a spring 4, a swing block 5, an LED 6 and an outer shade 7, wherein an interior of the main unit 1 is provided with an inner sink 11, an end of which is provided with a rabbet 111 and the other end of which is provided with an insert block 112. The inner seat 2 can be latched into the inner sink 11 of the main unit 1, with that a bump 21 (as shown in FIG. 2-1) at one end of the inner seat 2 can be latched into the rabbet 111 of the main unit 1, whereas a groove 22 at the other end can provide for latching the insert block 112 of the main unit 2. A bottom of the inner seat 2 is provided with a chamber 23 and an interior of the chamber 23 can provide for emplacement of a conductive spring 231 and two batteries 232 (as shown in FIG. 3). A top rod 2311 of the conductive spring 231 penetrates a through-hole 24 of the inner seat 2 and a top end of the inner seat 2 is provided with another through-hole 25 for transfixing the conductive rod 3.

The transfixed conductive rod 3 is in touch with a positive electrode of one battery 232 and a top end of the S-shaped conductive rod 3 is sheathed with a washer 31, followed by penetrating a bottom center of the spring 4. A top end of the spring 4 that is fixed on the inner seat 2 is connected with the swing block 5 and the LED 6 is installed on the inner seat 2. Two pins 62, 61 at a lower end of the LED 6 are connected respectively with the spring 4 and the top rod 2311 of the conductive spring 231. A flange 26 at a top end of the inner seat 2 is provided with a clamping block 27 and a bottom end of the transparent outer shade 7 is sheathed on the flange 26, whereas a clamping slot 71 at a bottom of the outer shade 7 is latched on the clamping block 27 for positioning.

Figure 4:
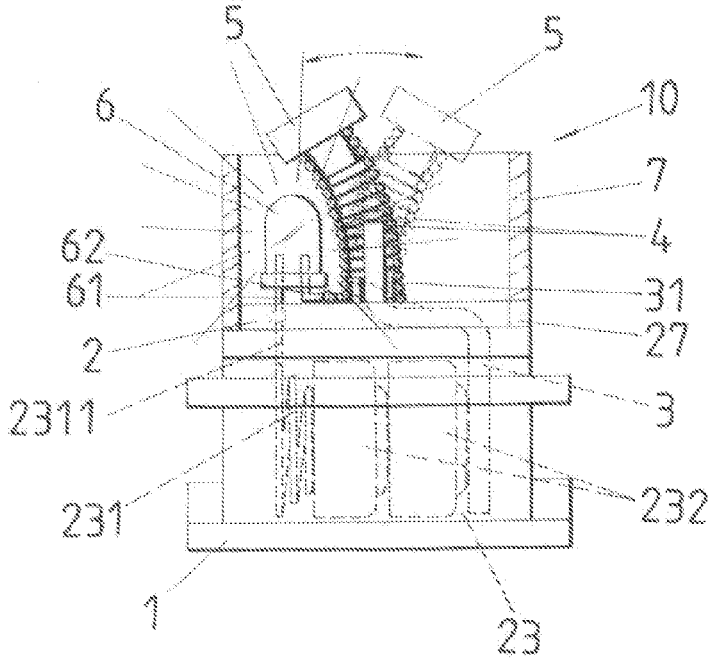
FIG. 4 shows a cutaway view of the present invention which illuminates.

Referring to FIG. 3, the spring 4 of the lighting element 10 does not touch the conductive rod 3 and at this time, an electric circuit is not conducted; hence, the LED 6 is unable to illuminate. Referring to FIG. 4, if a user shakes the main unit 1 of the lighting element 10, then the swing block 5 on the spring 4 will drive the spring 4 to swing without a fixed direction and when an inner surface of the spring 4 touches the conductive rod 3, the electric circuit will be conducted and thus, the LED 6 can illuminate. Of course, if the shaking stops, then the spring 4 will be restored to a previous stationary condition (as shown in FIG. 3), and the LED 6 will not be able to illuminate as the electric circuit is broken.

Figure 5:
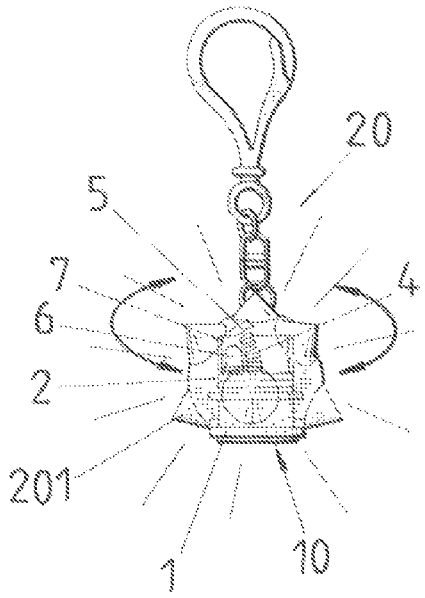
FIG. 5 shows three-dimensional schematic view of a first embodiment of the present invention.

Referring to FIG. 5, the lighting element 10 is installed in an ornament 201 of a key ring 20 and when the key ring 20 shakes, the lighting element 10 illuminates.

Figure 6:
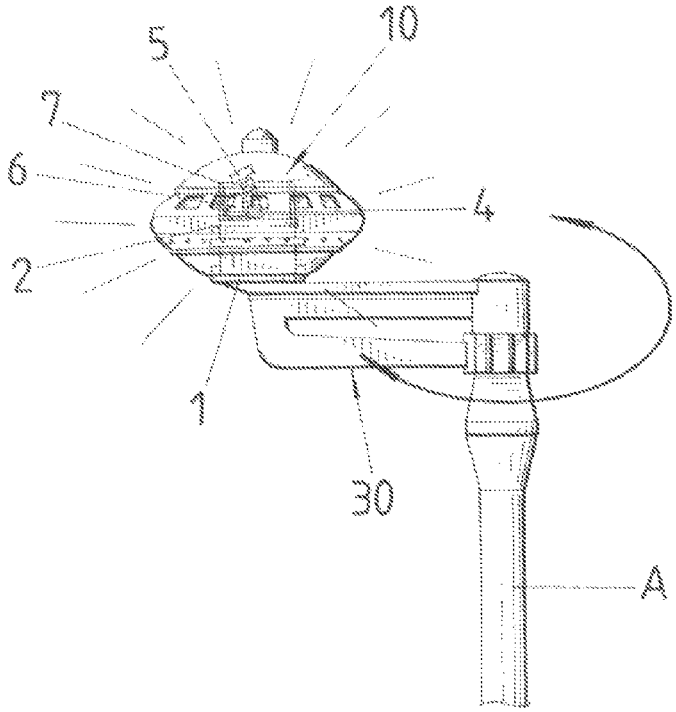
FIG. 6 shows a three-dimensional schematic view of a second embodiment of the present invention.

Referring to FIG. 6, the lighting element 10 is installed in a hand-shaking device 30 at a top end of a pen shaft A and when the hand-shaking device 30 rotates, the lighting element 10 illuminates.

Figure 7:
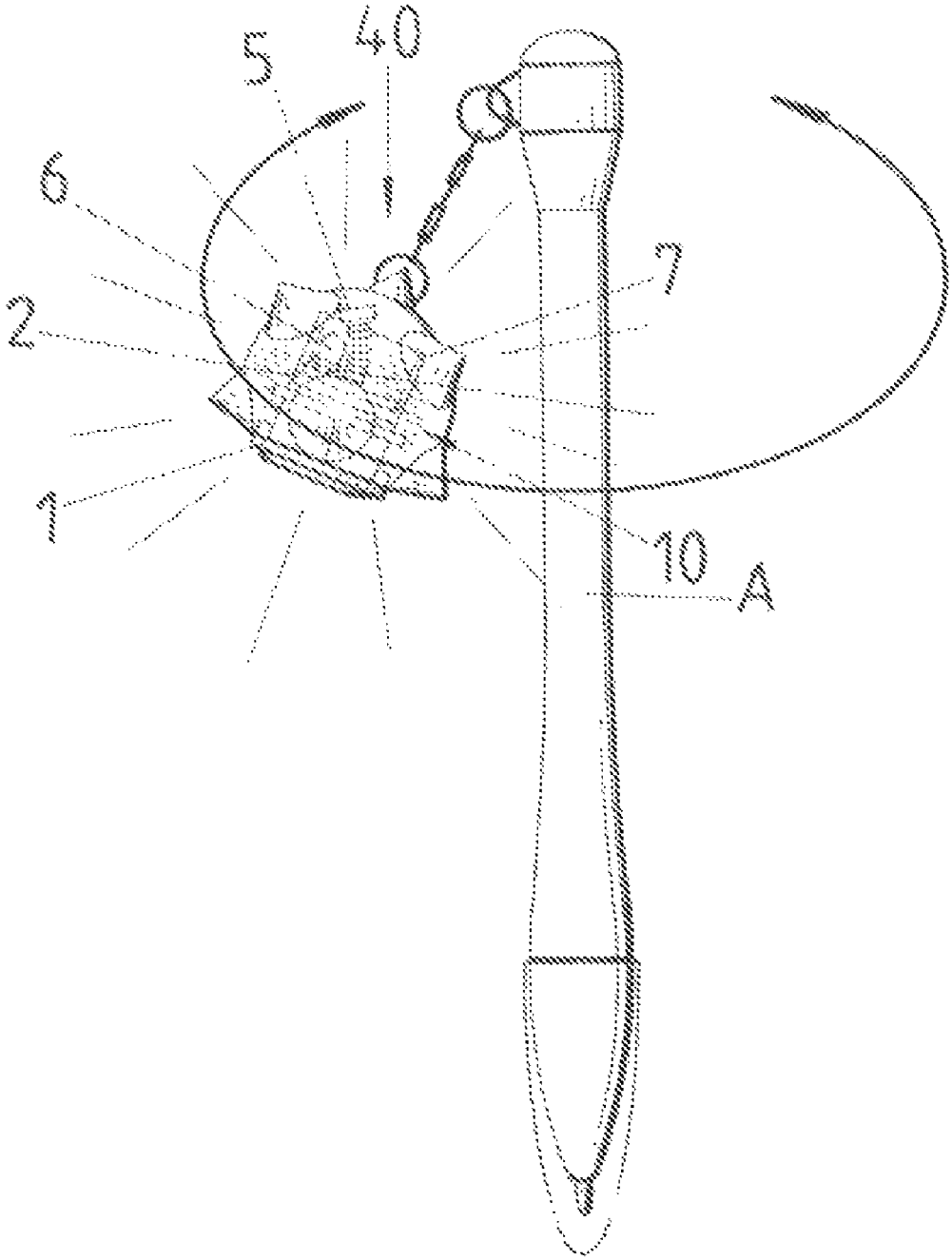
FIG. 7 shows a three-dimensional schematic view of a third embodiment of the present invention.

Referring to FIG. 7, the lighting element 10 is installed in a suspension device 40 at a top end of a pen shaft A and when the suspension device 40 rotates, the lighting element 10 illuminates.

In conclusion, the present invention is a lighting element 10 which is composed primarily of a main unit 1, a conductive rod 3, a spring 4, a swing block 5 and an LED 6. When the main unit 1 shakes, the swing block 5 will drive the spring 4 to swing and when the spring 4 touches the conductive rod 3, the LED 6 will illuminate.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A shakable lighting element comprising:

a main unit, an interior of which is provided with an inner sink, with an end of the inner sink being provided with a rabbet and the other end being provided with an insert block;

an inner seat, which is latched into the inner sink of the main unit, an end of which is provided with a bump to be latched into the rabbet of the main unit, the other end of which is provided with a groove for latching the insert block of the main unit and a bottom of which is provided with a chamber, with an interior of the chamber providing for emplacement of a conductive spring and two batteries, a top rod of the conductive rod penetrating a through-hole of the inner seat, a top end of the inner seat being provided with another through-hole and a flange that is provided with a clamping block;

the conductive rod which penetrates a through-hole of the inner seat and touches a positive electrode of a battery, with a top end of the conductive rod being sheathed with a washer;

a spring which is fixed on the inner seat and is sheathed at an exterior side of the conductive rod;

a swing block which is connected at a top end of the spring;

an LED, which is installed on the inner seat and two pins of which are connected respectively with the spring and the top rod of the conductive spring in the inner seat; and an outer shade, which is sheathed on the flange of the inner seat and a clamping slot at one end of which is latched on the clamping block of the inner seat for positioning;

when the lighting element, which is formed by the above-mentioned parts, shakes, the swing block on the spring driving the spring to swing and touch the conductive rod, allowing the LED to illuminate.

2. The shakable lighting element according to claim 1, wherein the conductive rod is in a shape of an S.

* * * * *